US008246424B2

(12) United States Patent
Philipps et al.

(10) Patent No.: US 8,246,424 B2
(45) Date of Patent: Aug. 21, 2012

(54) POLISHING DISC FOR A TOOL FOR THE FINE MACHINING OF OPTICALLY ACTIVE SURFACES PARTICULARLY ON SPECTACLE LENSES AND METHOD FOR ITS PRODUCTION

(75) Inventors: Peter Philipps, Mengerskirchen-Dillhausen (DE); Lothar Urban, Solms (DE)

(73) Assignee: Satisloh AG, Baar (CH)

( * ) Notice: Subject to any disclaimer, the term of this patent is extended or adjusted under 35 U.S.C. 154(b) by 1060 days.

(21) Appl. No.: 12/156,597

(22) Filed: Jun. 3, 2008

(65) Prior Publication Data

US 2008/0305723 A1 Dec. 11, 2008

(30) Foreign Application Priority Data

Jun. 6, 2007 (DE) ..... 10 2007 026 841

(51) Int. Cl.
*B24B 41/04* (2006.01)
*B24B 41/047* (2006.01)
*B29C 65/54* (2006.01)

(52) U.S. Cl. ..... 451/360; 156/256; 451/42; 451/290; 451/363; 451/533; 451/550; 451/913

(58) Field of Classification Search ..... 156/250, 156/256; 451/41, 42, 59, 158, 162, 285, 451/290, 360, 363, 495, 533, 550, 913
See application file for complete search history.

(56) References Cited

U.S. PATENT DOCUMENTS

| | | | | |
|---|---|---|---|---|
| 3,043,065 | A | 7/1962 | Terrel | |
| 3,526,065 | A * | 9/1970 | Lee | 451/490 |
| 5,695,393 | A | 12/1997 | Granziera | |
| 6,371,837 | B1 * | 4/2002 | Luedeke | 451/57 |
| 7,066,794 | B2 | 6/2006 | Granziera et al. | |
| 7,189,148 | B2 * | 3/2007 | Toyoshima et al. | 451/42 |
| 7,278,908 | B2 | 10/2007 | Urban et al. | |
| 2002/0061717 | A1 * | 5/2002 | Goulet et al. | 451/42 |
| 2004/0224619 | A1 * | 11/2004 | Granziera et al. | 451/277 |
| 2006/0154581 | A1 | 7/2006 | Bernard et al. | |
| 2007/0021036 | A1 | 1/2007 | Kuebler et al. | |

FOREIGN PATENT DOCUMENTS

JP 02048159 A 2/1990

* cited by examiner

*Primary Examiner* — Timothy V Eley
(74) *Attorney, Agent, or Firm* — Reising Ethington P.C.

(57) ABSTRACT

A polishing disc for a tool for the fine machining of optically active surfaces, particularly on spectacle lenses as workpieces, comprises a main body which has a center axis and on which there is fixed an intermediate layer which is softer than the main body and on which a polishing agent carrier rests. The intermediate layer has, with respect to the center axis, a radial inner region of substantially constant axial thickness and an adjoining radial outer region. The latter is formed or is fixed to the main body in a particular way so as to prevent the edge of the polishing disc from being imprinted on the machined surface of the workpiece in the form of very fine, scratch-like microstructures. Also proposed is a simple method which can be used to produce such a polishing disc.

22 Claims, 5 Drawing Sheets

POLISHING DISC FOR A TOOL FOR THE FINE MACHINING OF OPTICALLY ACTIVE SURFACES PARTICULARLY ON SPECTACLE LENSES AND METHOD FOR ITS PRODUCTION

TECHNICAL FIELD

The present invention relates to a polishing disc for a tool for the fine machining of optically active surfaces, which polishing disc comprises a main body that has a center axis and on which there is fixed an intermediate layer which is softer than the main body and on which a polishing agent carrier rests. Such polishing discs are used in large quantities in particular in the manufacture of prescription spectacle lenses. The invention also relates to a method for producing such a polishing disc.

When the term "spectacle lenses" is used below by way of an example of workpieces with optically active surfaces, this is to be understood to mean not only spectacle lenses made from mineral glass but rather also spectacle lenses made from all other customary materials, such as polycarbonate, CR 39, Hi-Index, etc., that is to say plastic as well.

PRIOR ART

The machining of the optically active surfaces of spectacle lenses can roughly be split into two machining phases, namely firstly the pre-machining of the optically active surface to produce the prescription macrogeometry and then the fine machining of the optically active surface to eliminate any traces left behind by the pre-machining and to obtain the desired microgeometry. While the pre-machining of the optically active surfaces of spectacle lenses takes place by grinding, milling and/or turning, depending inter alia on the material of the spectacle lenses, the optically active surfaces of spectacle lenses are usually subjected to a fine grinding, lapping and/or polishing operation during fine machining.

For this fine machining operation, the prior art (see e.g. the document U.S. Pat. No. 7,278,908) increasingly makes use of adaptable—as opposed to rigid—polishing discs which have a structure composed of at least three layers, with (1.) a relatively hard or rigid support body facing towards the tool spindle, to which (2.) a softer layer, e.g. a foam layer, is fixed, on which (3.) a grinding or polishing film facing towards the workpiece rests as the active machining part of the tool. Due to the elastic deformability of the foam layer, the polishing film can adapt within certain limits to the geometry of the surface to be machined, both in static terms, i.e. from spectacle lens to spectacle lens, and in dynamic terms, i.e. during the machining of a given spectacle lens, in which a relative movement takes place between the polishing disc and the spectacle lens. The elasticity of the foam layer also has a considerable influence on the abrasion behavior of the polishing disc during the polishing process.

When using such polishing discs with a polishing film which ends at the outer edge of the foam layer, it has been found that the polishing film edge or the rim formed by the latter may be machined into the machined surface of the spectacle lens. This may lead to visible and therefore undesirable imprint of the polishing film edge, i.e. to very fine, scratch-like microstructures on the optically active surface of the spectacle lens.

In order to eliminate this problem, it has already been proposed to dimension the polishing film such that it protrudes beyond the outer periphery of the foam layer (see FIGS. 1 and 4 of U.S. Pat. No. 7,278,908). Beyond the outer edge of the polishing film, it is no longer possible for any significant polishing pressure to be exerted on the surface to be machined. However, tests carried out by the applicant have shown that this measure alone does not bring the desired success in all cases.

Finally, U.S. Patent Publication 2007/0021036 discloses a polishing disc with a three-layer structure, in which the central, elastic layer is formed such that it becomes increasingly softer in the radial direction from the inside out, in order to polish spectacle lenses with irregularly curved free-form surfaces in a surface quality intended to make post-machining unnecessary. This design of becoming increasingly softer towards the outside is achieved in particular in that the central layer has an increasing axial thickness in the radial direction, i.e. from the inside out, with the support body, the central layer and the polishing film ending together at a cylindrical outer peripheral surface of the polishing disc. However, this prior art does not address the undesirable imprints of the polishing disc on the machined surface which are produced by the edge of the polishing film.

PROBLEM

Starting from the prior art as represented by U.S. Pat. No. 7,278,908 the problem on which the invention is based is that of providing a polishing disc of the simplest possible design for a tool for the fine machining of optically active surfaces particularly on spectacle lenses, wherein the edge of said polishing disc is not imprinted on the machined surface in the form of microstructures. The problem on which the invention is based is also that of providing a method for the simple production of such a polishing disc.

SUMMARY OF THE INVENTION

According to a first aspect of the invention, in the case of a polishing disc for a tool for the fine machining of optically active surfaces particularly on spectacle lenses, which comprises a main body which has a center axis and on which there is fixed an intermediate layer which is softer than the main body and on which a polishing agent carrier rests, the intermediate layer has, with respect to the center axis, a radial inner region of substantially constant axial thickness and an adjoining radial outer region having radial outer dimensions which increase from the main body towards the polishing agent carrier, so that the elastic support of the polishing agent carrier by the intermediate layer in the radial outer region thereof decreases towards the outer edge of the polishing agent carrier.

According to a second aspect of the invention, in the case of a polishing disc for a tool for the fine machining of optically active surfaces particularly on spectacle lenses, which comprises a main body which has a center axis and on which there is fixed an intermediate layer which is softer than the main body and on which a polishing agent carrier rests, the intermediate layer has, with respect to the center axis, a radial inner region of substantially constant axial thickness and an adjoining radial outer region, wherein the outer edge of the polishing agent carrier is kept at a distance from the optically active surface by means of the radial outer region of the intermediate layer during the fine machining of said optically active surface.

In both cases, therefore, in the polishing disc according to the invention, the intermediate layer is functionally split into a radial inner region of substantially constant axial thickness and an adjoining radial outer region which is assigned the task of preventing the edge of the polishing disc from being imprinted on the machined surface in the form of microstructures. Since the inner region has a substantially constant axial thickness, the elasticity or flexibility of the polishing disc does not vary over the radius thereof, unlike in the prior art according to U.S. Patent Publication 2007/0021036 As a result, given a suitable relative movement between the tool and the workpiece, advantageously a uniform polishing abrasion is achieved—Preston's hypothesis: the polishing abrasion is proportional to the product of the polishing pressure and the relative speed between the tool and the workpiece—so that the workpiece can be polished with a high constancy of topography, i.e. in a shape-retaining manner. Only in the edge region of the polishing disc, in which the radial outer region of the intermediate layer is located, does the polishing abrasion decrease due to a decreasing elastic support of the polishing agent carrier or due to the fact that the latter maintains space from the machined surface, and thus the possibility that the edge of the polishing disc can be imprinted on the machined surface is also reduced.

In the edge region of the polishing disc in which the radial outer region of the intermediate layer is located, said intermediate layer additionally ensures, in the first variant of the polishing disc according to the invention, that the outer edge of the polishing agent carrier which protrudes radially outwards beyond the radial inner region of the intermediate layer is damped with regard to its movements and hence cannot oscillate or wobble freely during the fine machining of the optically active surface and thus also cannot strike the machined surface in such a way as to be imprinted thereon. In the second variant of the polishing disc according to the invention, the radial outer region of the intermediate layer is chamfered to be spaced away from the machined surface the outer edge of the polishing agent carrier protruding radially outwards beyond the radial inner region of the intermediate layer, in order to avoid the imprints.

In the first variant of the polishing disc according to the invention, the peripheral contour formed by the radial outer region of the intermediate layer may in principle have any desired geometry, provided that the radial outer dimensions of the radial outer region of the intermediate layer increase (preferably continuously) from the main body towards the polishing agent carrier, e.g. the radial outer region of the intermediate layer may have a toric outer peripheral surface. However, with regard to simple production of the polishing disc, preference is given to a configuration in which the radial outer region of the intermediate layer has a substantially frustoconical outer peripheral surface.

In the second variant of the polishing disc according to the invention, the intermediate layer may have a peripheral chamfer or edge rounding in the radial outer region on the side facing towards the polishing agent carrier, wherein the polishing agent carrier is also fixed, preferably securely adhesively bonded, to the intermediate layer in the region of the chamfer or edge rounding. In addition or as an alternative to this, a peripheral chamfer or edge rounding may be formed on the outer peripheral surface of the main body on the side thereof facing towards the intermediate layer, on which chamfer or edge rounding the intermediate layer is fixed, preferably securely adhesively bonded, with its radial outer region. Such chamfers or edge roundings on the intermediate layer and/or the main body can be formed in a simple manner, for instance by water jet cutting in the case of an intermediate layer made from a foam or by a suitable design of the injection mold in the case of a main body injection-molded from a plastic.

In principle, it is possible for the main body to have an end face, facing towards the intermediate layer, which is pre-shaped according to the macrogeometry of the surface to the machined, for example in a toric manner, as described for example in U.S. Pat. No 7,278,908. However, tests carried out by the applicant have shown that it is sufficient for most machining cases if the main body has a substantially spherical end face facing towards the intermediate layer, to which end face the intermediate layer is securely adhesively bonded. On the one hand this simplifies the production of the polishing disc, and on the other hand it reduces the number of polishing discs that have to be available for the fine machining of spectacle lenses in prescription manufacture.

Both in the first and in the second variant of the polishing disc according to the invention, the polishing agent carrier may be provided with at least one opening in a central region. This opening in the polishing agent carrier ensures a fluid connection between an inner region of the intermediate layer, which is usually made from a foam and is fully saturated with liquid polishing agent in the manner of a sponge during the machining operation, and the outer surface of the polishing agent carrier which is in machining engagement with the surface of the workpiece that is to be machined. The liquid polishing agent can thus circulate more easily and can also pass from the interior of the polishing disc to the engagement regions between the polishing agent carrier and the surface of the workpiece that is to be machined, as a result of which better rinsing and cooling is ensured at these engagement regions due to an increased wetting of the polishing agent carrier and a more uniform film of polishing agent on the latter. Accordingly, there is no partial hardening of the polishing agent carrier which would be detrimental to the surface quality produced. Furthermore, the opening in the polishing agent carrier advantageously ensures relief of the hydraulic pressure which builds up in the intermediate layer due to the deformation of the latter, which might otherwise lead for example to partial destruction of the intermediate layer, and also ensures an internal cooling of the polishing disc.

It is furthermore preferred if the at least one opening in the polishing agent carrier is adjoined in the direction of the main body by a cutout in the intermediate layer. Such a cutout may advantageously serve as a reservoir for the liquid polishing agent.

If a cutout is provided in the intermediate layer, this may extend as far as the main body. Such a continuous cutout is not only particularly easy to produce but also advantageously maximizes the holding capacity of the reservoir for the liquid polishing agent which is formed by the cutout. A further increase in size of the polishing agent reservoir is possible if the cutout in the intermediate layer is also adjoined by a cutout in the main body.

Furthermore, it is preferred if the diameter of the cutout in the intermediate layer increases, preferably continuously, from the opening in the polishing agent carrier towards the main body, for example by the cutout being delimited by a conical inner peripheral surface of the intermediate layer. As a result, in a manner analogous to the radial outer dimensions of the radial outer region of the intermediate layer which increase from the main body towards the polishing agent carrier, the elastic support of the polishing agent carrier by the radial inner region of the intermediate layer decreases from a region close to the opening in the polishing agent carrier towards the opening, in order even at relatively high polishing pressures to eliminate the risk that the opening edge of the polishing agent carrier is imprinted on the machined surface.

Tests carried out by the applicant have shown that the maximum radial width of the radial outer region of the intermediate layer in the non-deformed state of the polishing disc should be between 3 and 10% of the maximum total width of the intermediate layer in order to elastically support the polishing agent carrier in a substantially constant manner on a surface that is as large as possible, without there being any risk of causing imprints of the polishing disc edge on the machined surface.

The polishing disc according to the invention may advantageously be used on a tool for the fine machining of optically active surfaces particularly on spectacle lenses, comprising a main body which can be attached to a tool spindle of a machining machine, an articulated part which has a holding section guided such that it can be tilted and moved longitudinally with respect to the main body, which holding section is adjoined in the direction of the main body by a bellows section, by means of which the articulated part is fixed to the main body such that it can rotate therewith, and a pressure medium chamber which is delimited by the main body and the articulated part and which can selectively be acted upon by a (liquid or gaseous) pressure medium, wherein the polishing disc is held on the holding section of the articulated part in an exchangeable manner.

In order to ensure that the polishing disc can be exchanged as easily as possible, it is preferred if the polishing disc is held on the holding section of the articulated part by means of a snap-in connection.

One particularly simple method for producing the polishing disc according to the first variant according to the invention provides, in a further continuation of the invention, the following steps:

(a) forming the main body—e.g. by machining or, in a particularly cost-effective manner that is preferred here, by injection molding, in particular from plastic;

(b) providing a flat raw material for the intermediate layer, which has a substantially constant thickness—such a raw material, for example foam panels, is readily available on the market and is inexpensive;

(c) pulling taut the raw material for the intermediate layer over a convexly curved surface of a counter-punch and punching out the intermediate layer by means of a punching tool having an annular cutter—here, an outer peripheral surface on the intermediate layer, i.e. the punched-out raw material section, is produced in a particular simple manner since it is automatic as it were, and it has substantially a frustoconical shape already in the non-deformed, flat state of the raw material section;

(d) optionally cutting the polishing agent carrier to match the larger end face of the non-deformed intermediate layer, i.e. the non-deformed, flat raw material section—such a separate cutting operation can be omitted if the polishing agent carrier is already formed in one piece with the intermediate layer, e.g. by means of the so-called "casting skin" (release layer for releasing from the casting mold) on a foam part, which is produced as a result of the manufacturing technology and is usually cut away in the case of commercially available foam panels; and (e) adhesively bonding the main body, the intermediate layer and—if provided separately—the polishing agent carrier to form the sandwich-like assembly described above.

Furthermore, the cutting of the polishing agent carrier may take place by means of the punching tool and the counter-punch for punching out the intermediate layer, so that no separate tool has to be used for this and the cutting operation can take place quickly. Finally, the punching-out of the intermediate layer and the cutting of the polishing agent carrier may take place in a common operating step if these are separate raw materials. This also helps to achieve a rapid, accurate production of the polishing disc.

BRIEF DESCRIPTION OF THE DRAWINGS

The invention will be explained in more detail below on the basis of preferred examples of embodiments and with reference to the appended, partially schematic drawings, in which identical references denote identical or corresponding parts. In the drawings.

DETAILED DESCRIPTION OF THE EXAMPLES OF EMBODIMENTS

Figure 1:
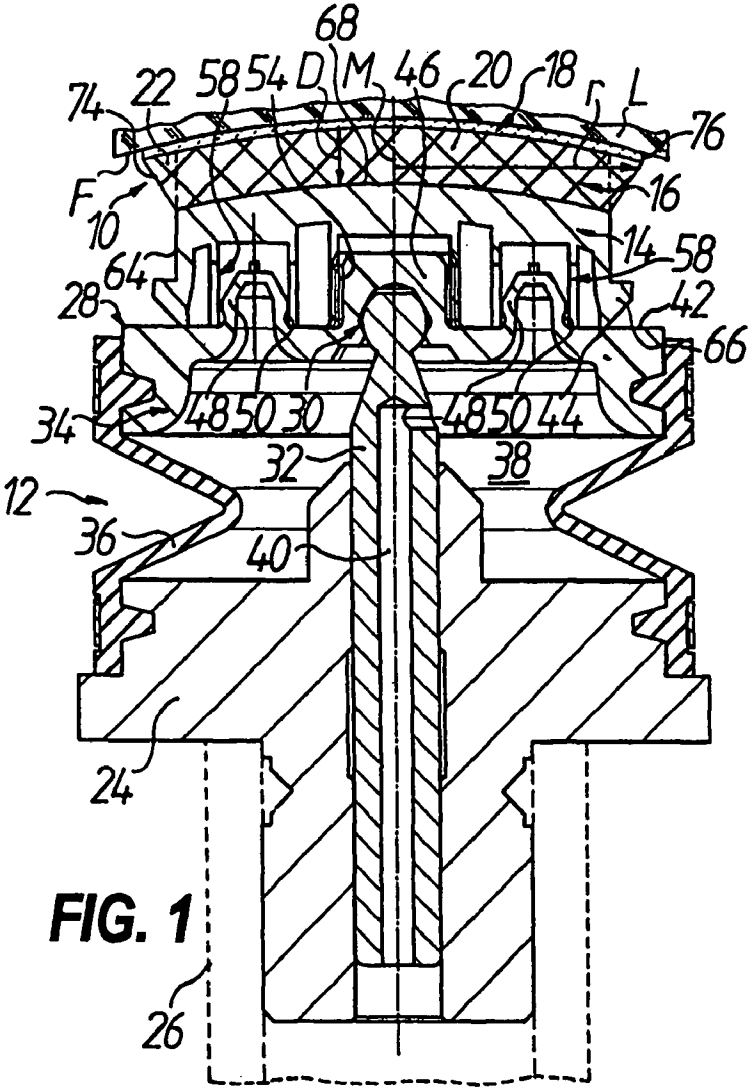
FIG. 1 shows, on a somewhat enlarged scale compared to reality, a broken-off longitudinal sectional view of a tool for the fine machining of optically active surfaces on spectacle lenses, on which a polishing disc according to a first example of embodiment of the invention is releasably held, which polishing disc is in machining engagement with a surface that is to be machined.

According to FIGS. 1, 5, 6 and 9 to 12, a polishing disc 10 for a tool 12 for the fine machining of optically active surfaces F particularly on spectacle lenses L comprises a main body 14 which has a center axis M and on which there is fixed an intermediate layer 16 which is softer than the main body 14 and on which a polishing agent carrier 18 rests. It is essential that the intermediate layer 16 has, with respect to the center axis M, a radial inner region 20 of substantially constant axial thickness D and an adjoining radial outer region 22 which, as will be described in greater detail below, is designed and fixed in a particular way so as to prevent the edge of the polishing disc 10 from being imprinted on the machined surface F of the spectacle lens L in the form of very fine, scratch-like microstructures. In FIGS. 1, 5, 6 and 9 to 12, dashed lines indicate the boundary between the radial inner region 20 and the radial outer region 22 of the intermediate layer 16.

Figure 2:
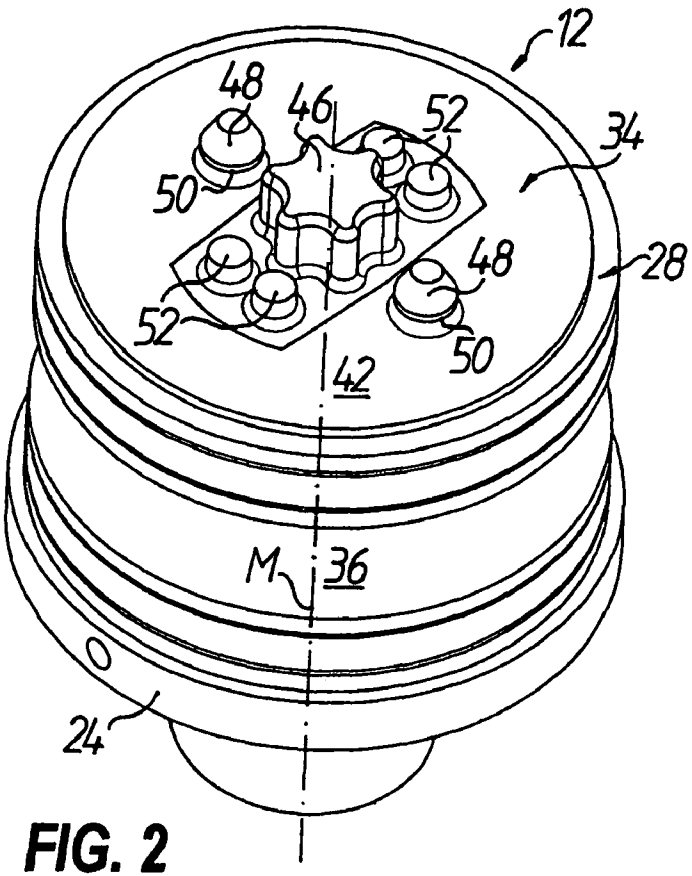
FIG. 2 shows a perspective view of the tool according to FIG. 1 obliquely from the front/from above, wherein the polishing disc has been removed from the tool in order to show on the tool side the interface between the tool and the polishing disc.

As shown in FIGS. 1 and 2, the tool 12 comprises a main body 24 which can be attached to a tool spindle 26 (shown in dashed line in FIG. 1) of a machining machine (not shown in any greater detail). The tool 12 also comprises an articulated part, denoted in general by reference 28, which has a holding section 34 guided such that it can be tilted and moved longitudinally with respect to the main body 24 by means of a spherical head connection 30 and a guide element 32, on which holding section the polishing disc 10 is held in an exchangeable manner to be described in greater detail below. The holding section 34 is adjoined in the direction of the main body 24 by a bellows section 36, by means of which the articulated part 28 is fixed to the main body 24 such that it can rotate therewith. The main body 24 and the articulated part 28 delimit a pressure medium chamber 38, which can selectively be acted upon by a suitable liquid or gaseous pressure medium (e.g. oil or compressed air) via a channel 40 in the guide element 32 in order to apply a machining pressure via the holding section 34 and the polishing disc 10 resting thereon during the machining of the optically active surface F on the spectacle lens L. Further details regarding the structure of the tool 12 can be found in the documents U.S. Pat. No. 7,278,908 and U.S. Pat. No. 7,066,794 which are incorporated by reference in this respect at this point in order to avoid repetitions.

It can thus be seen that the holding section 34 of the articulated part 28 is supported by means of the guide element 32 in the transverse direction relative to the main body 24 of the tool 12. At the same time, the guide element 32 can follow the holding section 34 in the axial direction, and vice versa, when the pressure medium chamber 38 is acted upon by the pressure medium via the channel 40 and the holding section 34 is pushed in the direction of the main body 24 by an external influence (from above in FIG. 1). Moreover, the holding section 34 of the articulated part 28 can tilt on the guide element 32 via the spherical head connection 30 to the guide element 43, whereby the bellows section 36 of the articulated part 28 is deformed accordingly.

In order to ensure a secure hold of the polishing disc 10 on and a rotation of the polishing disc 10 with the holding section 34 of the tool 12, structures of complementary shape which engage in one another in particular with a form fit are formed on the facing surfaces of the holding section 34 of the articulated part 28 and the main body 14 of the polishing disc 10, i.e. on an upper end face 42 of the holding section 34 in FIG. 1 and on the underside 44 of the main body 14. These structures can best be seen in FIGS. 2 (tool 12) and 3 (polishing disc 10).

Accordingly, the holding piece 34 of the articulated part 28, which is preferably injection-molded from a plastic, is provided on its end face 42 with a central rotation-transmitting protrusion 46 which, as seen in plan view, has substantially the shape of a six-pointed star (Torx®-like outer profile). On opposite sides of the rotation-transmitting protrusion 46, a respective, substantially mushroom-shaped retaining protrusion 48 is provided on the end face 42 of the holding section 34, which forms an undercut 50. Furthermore, the holding section 34 is provided on its end face 42 with a total of four, substantially cylindrical orientation protrusions 52 which are arranged in pairs on opposite sides of the rotation-transmitting protrusion 46 and are offset by an angle of 90° about the center axis M relative to the retaining protrusions 48.

The main body 14 of the polishing disc 10 on the other hand, which is likewise preferably injection-molded from a plastic, such as an ABS (Acrylonitrile/Butadiene/Styrene polymer), for instance Terluran® GP 35 from the company BASF, is formed like a honeycomb on its underside 44, with a centrally arranged counter-profile 54 for the rotation-transmitting protrusion 46 on the tool 12, from which reinforcing webs 56 extend in a star-shaped manner to the outer edge of the main body 14, and substantially hollow-cylindrical retaining sections 58 which are arranged on opposite sides of the counter-profile 54 between the reinforcing webs 56 and cooperate with the retaining protrusions 48 on the tool 12 in order to hold the polishing disc 10 on the holding section 34 of the articulated part 28 in the manner of a snap-in connection. To this end, as seen in plan view (FIG. 4), the retaining sections 58 are slit in a cross-shaped manner in order to form in each case four spring arms 60, wherein each spring arm 60 carries at its free end a latching tab 62 (shown in FIG. 3) which is directed radially inwards with respect to an axis of symmetry of the respective retaining section 58 and which is dimensioned and arranged in such a way that it can latch into the undercut 50 on the respectively associated retaining protrusion 48 of the tool 12.

It is therefore obvious to the person skilled in the art that the form-fitting engagement of the rotation-transmitting protrusion 46 and the counter-profile 54 ensures that the polishing disc 10 moves and in particular rotates with the tool 12 substantially without play, while in a manner functionally separate from this the retaining protrusions 48 cooperate with the retaining sections 58 in order to hold the polishing disc 10 on the tool 12 by latching in the axial direction. Here, the orientation protrusions 52 in cooperation with the reinforcing webs 56 ensure that the polishing disc 10 cannot be placed on the tool 12 in an angularly offset manner such that the polishing disc 10 bears flat with its underside 44 against the end face 42 of the tool 12 without a latching taking place between the retaining protrusions 48 and the retaining sections 58. Given the correct relative angular position between the polishing disc 10 and the tool 12, and with the polishing disc 10 mounted on the tool 12, a reinforcing web 56 extends in each case between a pair of orientation protrusions 52, namely those reinforcing webs 56 which are arranged offset by an angle of 90° about the center axis M with respect to the retaining sections 58 of the main body 14.

Figure 3:
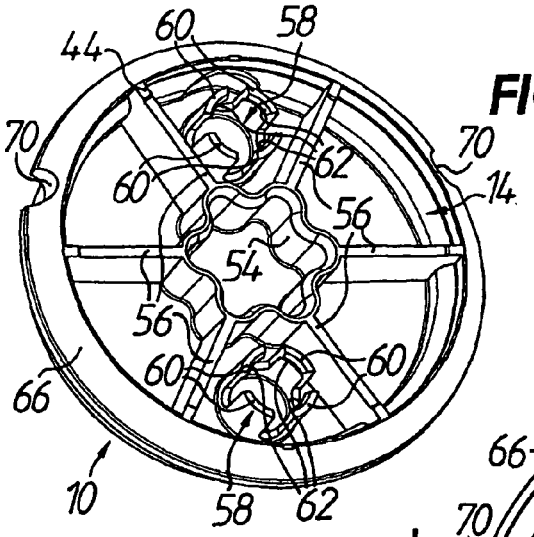
FIG. 3 shows a perspective view, obliquely from the left/from below, of the polishing disc according to FIG. 1 which has been removed from the tool in order to show on the polishing disc side the interface between the tool and the polishing disc.
Figure 4:
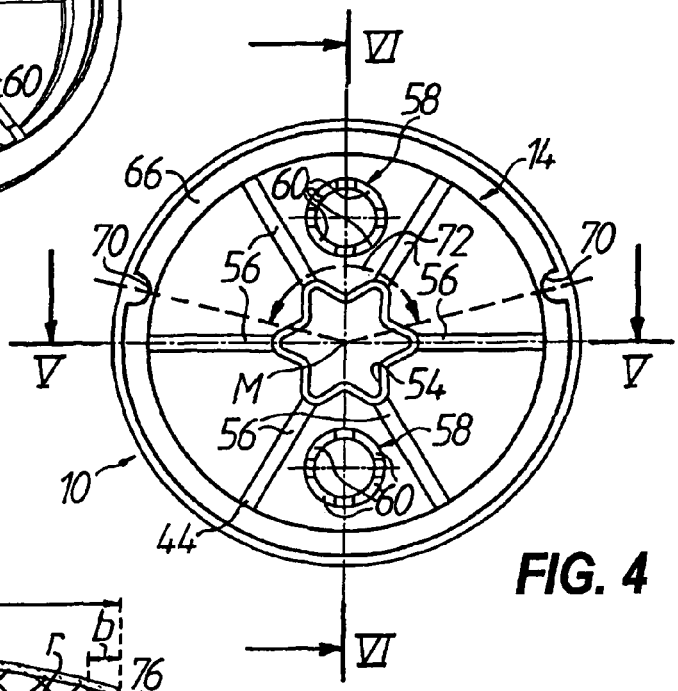
FIG. 4 shows a view from below of the polishing disc according to FIG. 3 removed from the tool, from below in FIG. 1.
Figure 5:
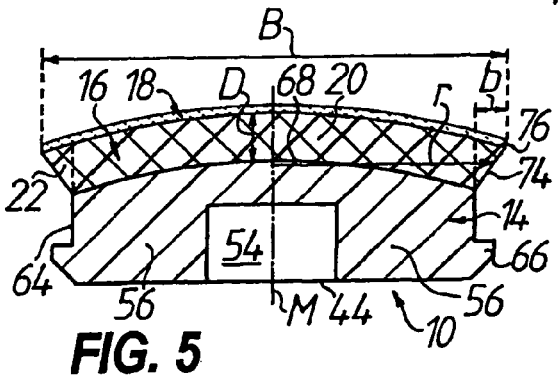
FIG. 5 shows a sectional view of the polishing disc according to FIG. 3 along the section line V-V in FIG. 4.
Figure 6:
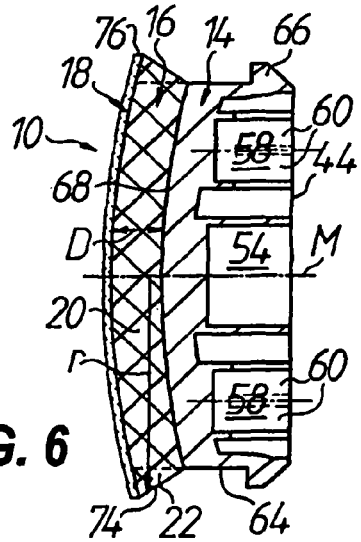
FIG. 6 shows a sectional view of the polishing disc according to FIG. 3 along the section line VI-VI in FIG. 4.

As can be seen from FIGS. 1 and 3 to 6, the underside 44 of the main body 14 is adjoined on the outer peripheral side by an annular collar 66 which protrudes radially outwards beyond the otherwise cylindrical outer peripheral surface 64 of the main body 14 and which, as shown in FIGS. 1, 5 and 6, has a hook-shaped cross section. The annular collar 66 serves as a handle for a gripper (not shown) of an automatic polishing disc changing device (likewise not shown).

The upper end face 68 of the main body 14 in FIGS. 1 and 5, which adjoins the intermediate layer 16, is shaped in a substantially spherical manner in the illustrated examples of embodiments and curves as it were towards the intermediate layer 16. However, depending on the macrogeometry of the surface F that is to be machined, the end face 68 may also be shaped differently, e.g. torically.

With regard to the configuration of the main body 14, it should finally also be mentioned that the annular collar 66, as shown in FIGS. 3 and 4, is provided on its outer circumference with two cutouts 70 which are semicircular when seen in plan view. These cutouts serve for marking the polishing disc 10, namely such that the angular spacing between the cutouts 70 about the center axis M, which is denoted by reference 72 in FIG. 4, is a coded indication of the curvature (in diopters) of the end face 68.

The intermediate layer 16 is securely fixed to the end face 68 of the main body 14 for example by means of a suitable adhesive. The material of the intermediate layer 16 may be for example an open-cell PUR (polyurethane) foam, as available for example under the trade name Sylomer® R from Getzner Werkstoffe GmbH, Berlin, Germany. This has a hardness of approximately 60 Shore A. The upper side of the intermediate layer 16 facing towards the polishing agent carrier 18 may be provided, but need not be provided, with a final "casting skin" (release layer for releasing from the casting mold, not shown), which is produced as a result of the manufacturing technology and gives the intermediate layer 16 additional rigidity. Such a "casting skin" may optionally even form the polishing agent carrier itself. The thickness D of the intermediate layer 16 in the radial inner region 20 thereof may be for example between 2 and 10 mm, depending on the respective machining requirements. As already mentioned, this thickness D in the radial inner region 20 of the intermediate layer 16 is substantially constant, so that the elastic support of the polishing agent carrier 18 by the intermediate layer 16 is likewise substantially constant in this region 20.

In the first example of embodiment, the radial outer dimensions r of the radial outer region 22 of the intermediate layer 16 increase continuously from the main body 14 towards the polishing agent carrier 18, namely in such a way that the radial outer region 22 of the intermediate layer 16 has a substantially frustoconical outer peripheral surface 74, the inclination of which relative to the center axis M is greater than the inclination of any surface normal on the end face 68 of the main body 14 relative to the center axis M—so that the elastic support of the polishing agent carrier 18 by the intermediate layer 16 in the radial outer region 22 thereof decreases continuously towards the outer edge 76 of the polishing agent carrier 18. As already mentioned above, this means that the polishing pressure and thus the polishing abrasion decreases in the edge region of the polishing disc 10, and at the same time the outer edge 76 of the polishing agent carrier 18 is damped with regard to its axial movements compared to a free, unsupported outer edge of the polishing agent carrier as known from U.S. Pat. No. 7,278,908. As a result, this prevents the outer edge 76, in particular the upper rim of the polishing agent carrier 18 in FIGS. 1 and 5 which is formed by said edge, from undesirably being imprinted onto the machined surface F of the spectacle lens L.

It should also be mentioned in this connection (cf. FIG. 5) that the maximum radial width b of the radial outer region 22 of the intermediate layer 16 in the non-deformed state of the polishing disc 10, i.e. when the latter is not pressed against the surface F of the spectacle lens L that is to be machined, is approximately between 3 and 10% of the maximum total width B of the intermediate layer 16. Finally, it should also be pointed out that the transition between the outer peripheral surface 64 of the main body 14 and the outer peripheral surface 74 of the intermediate layer 16 need not necessarily be smooth. In particular, the main body may protrude radially outwards relative to the intermediate layer, as disclosed for example in U.S. Pat. No. 7,278,908.

The polishing agent carrier 18, also known as the polishing film or polishing pad, which as shown in FIG. 1 forms the active machining part of the tool, is a commercially available, elastic and wear-resistant fine grinding agent carrier or polishing agent carrier, such as for example a PUR (poly urethane) film, which has a thickness of 0.5 to 1.4 mm and a hardness of between 12 and 45 Shore D. The polishing agent carrier 18 is designed to be somewhat thicker if a pre-polishing operation is to be carried out by means of the polishing disc 10, and on the other hand somewhat thinner in the case of a fine polishing operation.

As can already been seen from the explanations given above, the radial dimensions of the polishing agent carrier 18 are selected such that the polishing agent carrier 18, which is circular in this example of embodiment when seen in plan view from above in FIGS. 1 and 5, ends with its outer edge 76 at the outer peripheral surface 74 of the intermediate layer 16 located therebelow.

Finally, in the illustrated example of embodiment, the polishing agent carrier 18 is fixed to the intermediate layer 16 by means of a suitable adhesive. However, the polishing agent carrier 18 may also be connected more or less durably to the intermediate layer 16 in some other way, for example by being vulcanized onto it or attached by Velcro. In any case, the connection between the polishing agent carrier 18 and the intermediate layer 16 must be secure enough that, at any time during the machining operation, the polishing agent carrier 18 can move and in particular rotate with the intermediate layer 16.

During the fine machining of the optically active surface F of the spectacle lens L that is to be machined, which takes place in a manner known per se by means of unbound particles which are supplied by a suitable liquid to the point of engagement between the polishing disc 10 and the spectacle lens L—predominantly through tubes (not shown) which can be flexibly adjusted from outside—the tool 12 and the spectacle lens L are driven substantially synchronously, i.e. in the same direction and at substantially the same speed, again in a manner known per se. During this, the tool 12 and the spectacle lens L are at the same time pivoted relative to one another, so that the region of engagement between the polishing disc 10 and the spectacle lens L constantly changes. These fine machining methods, in which for example in the case of machining free-form surfaces the pivoting movement takes place at a fixed setting about the center point of a best fit radius, i.e. an approximated center point of the surface F of the spectacle lens L that is to be machined, or else the relative movement between the tool 12 and the spectacle lens L is produced by a path-controlled method in two CNC linear axes and optionally one CNC rotational axis, have been known to the person skilled in the art for a long time and therefore need not be described in any greater detail at this point.

Figure 8:
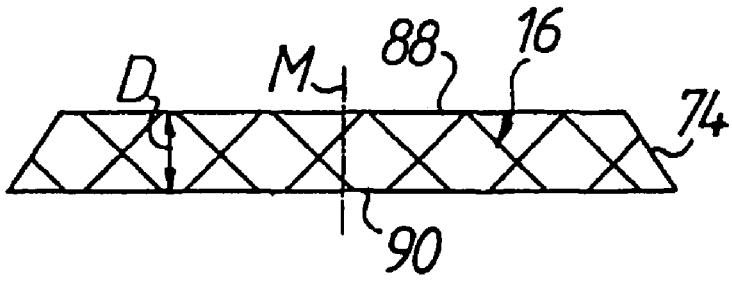
FIG. 8 shows a schematic longitudinal sectional view of an intermediate layer punched out by the device according to FIG. 7, before said intermediate layer is adhesively bonded to the main body and to the polishing agent carrier in order to form the polishing disc according to the first example of embodiment of the invention.
Figure 7:
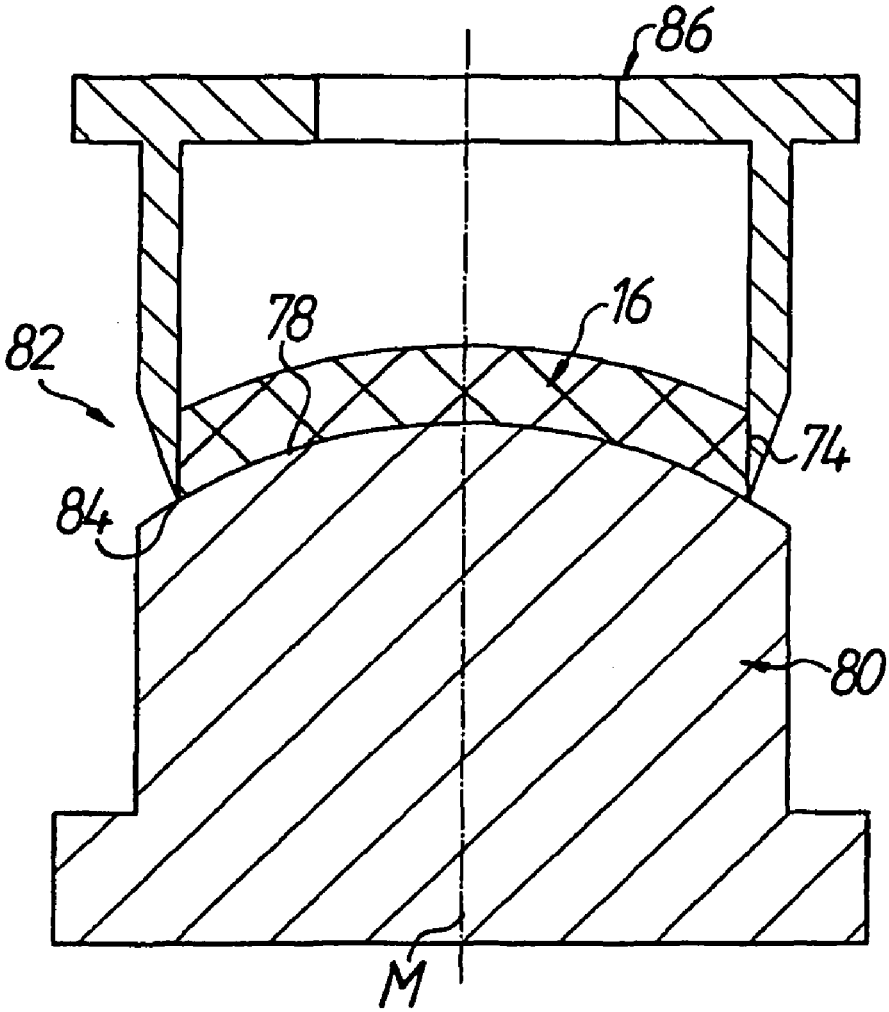
FIG. 7 shows a schematic longitudinal sectional view of a device for punching out the intermediate layer for the polishing disc according in particular to the first example of embodiment of the invention, by means of which a substantially frustoconical outer peripheral surface can be formed on the radial outer region of the intermediate layer.

One particularly simple method for producing the above-described polishing disc 10 comprises the following steps, with reference also being made to FIGS. 7 and 8:

(a) forming the main body 14, in particular by injection-molding from plastic, wherein the complete geometry of the main body 14 with the counter-profile 54, reinforcing webs 56 and retaining sections 58, with compulsory deformation of the latching tabs 62, is simultaneously formed on the underside 44, the annular collar 66 on the outer periphery and the substantially spherical end face 68, and without the need for post-machining, i.e. it comes completely produced straight off the tool.

(b) providing a flat raw material—easily obtainable commercially—for the intermediate layer 16, which has a substantially constant thickness D.

(c) pulling taut the raw material for the intermediate layer 16 over a convexly curved surface 78 of a counter-punch 80 of a punching device 82 shown schematically in FIG. 7, and punching out the intermediate layer 16—optionally while holding down the latter on the counter-punch surface 78—by means of a punching tool 86 of the punching device 82 having an annular cutter 84. This results in the cut intermediate layer 16 shown in FIG. 8, which in the non-deformed, flat state has a first end face 88, a second end face 90 and an outer peripheral surface 74, wherein the latter already has a substantially frustoconical shape as a result of the punching technique described above.

(d) cutting the polishing agent carrier 18 to match the larger second end face 90 of the non-deformed intermediate layer 16 (see FIG. 8). This may preferably be carried out by means of the punching tool 86 and the counter-punch 80 for punching out the intermediate layer 16, possibly even in the same operating step, i.e. the operating step just described.

(e) adhesively bonding the main body 14, the intermediate layer 16 and the polishing agent carrier 18 to form the sandwich-like assembly shown in FIGS. 1, 5 and 6, wherein the polishing agent carrier 18 is adhesively bonded onto the second end face 90 of the intermediate layer 16 and the intermediate layer 16 is adhesively bonded with its first end face 88 onto the main body 14. During this, the intermediate layer 16 expands out even further as a result of the forward curvature of the end face 68 of the main body 14, i.e. the inclination of the substantially frustoconical outer peripheral surface 74 of the intermediate layer 16 with respect to the center axis M increases further on the finished polishing disc 10 (FIGS. 1 and 3 to 6) compared to the intermediate layer 16 in the non-deformed state (FIG. 8).

It should also be mentioned at this point that the adhesive bonding of an intermediate layer, which has a cylindrical outer peripheral surface in the non-deformed, flat state, onto a forward curved end face of the main body would also lead to an expansion of the intermediate layer, so that the outer peripheral surface of the intermediate layer then has essentially a slight frustoconical shape. However, unlike in the design of the polishing disc described above, this would not lead to the situation where the elastic support of the polishing agent carrier by the intermediate layer, which is to be seen normal to the end face of the main body, decreases towards the outer edge of the polishing agent carrier.

In order to avoid repetitions, the further examples of embodiments will be described below only in so far as they differ from the first example of embodiment described above with reference to FIGS. 1 to 8.

Figure 9:
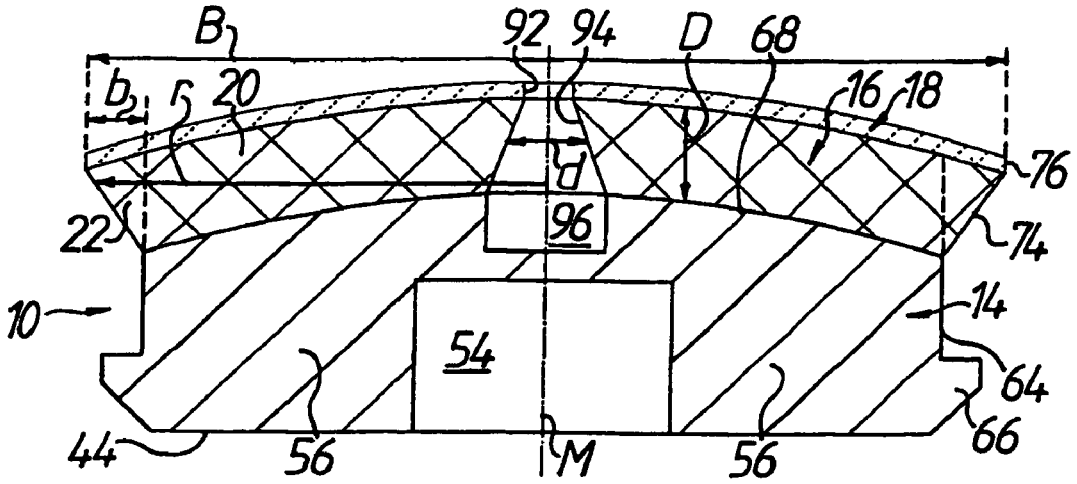
FIG. 9 shows a sectional view, corresponding to the section shown in FIG. 5, of a polishing disc according to a second example of embodiment of the invention, on a scale further enlarged compared to FIG. 5, with a central opening in the polishing agent carrier.

In the second example of embodiment shown in FIG. 9, the polishing agent carrier 18 is additionally provided in a central region with at least one continuous opening 92 which in the illustrated example has a circular shape and may be formed for example by cutting or punching. Preferably, the opening 92 in the polishing agent carrier 18 covers a surface area of 0.25 to 2% of the total end face of the polishing agent carrier 18 facing towards the surface F of the spectacle lens L that is to be machined. During the machining operation, the opening 92 ensures pressure equalization and provides liquid polishing agent from the interior of the intermediate layer 16, as a result of which better rinsing and cooling of otherwise disadvantaged areas of the polishing disc 10 is achieved. Such a centrally located supply of polishing agent is particularly advantageous when the polishing disc 10 rotates at a relatively high speed and thus the acting centrifugal forces strive to drive the polishing agent radially outwards.

In the example of embodiment shown in FIG. 9, the opening 92 in the polishing agent carrier 18 is adjoined in the direction of the main body 14 by a cutout 94 in the intermediate layer 16, which cutout extends as far as the main body 14. The cutout 94 in the intermediate layer 16 is also smoothly adjoined by a cutout 96 in the main body 14. The cutouts 94 and 96 in the intermediate layer 16 and respectively in the main body 14 serve during the machining operation as an extended reservoir for the liquid polishing agent.

While the cutout 96 in the main body 14 is cylindrical, the diameter d of the cutout 94 in the intermediate layer 16 increases continuously from the opening 92 in the polishing agent carrier 18 towards the main body 14. Such a shape of the cutout 94 can be produced by punching in the same way as the substantially frustoconical outer peripheral surface 74 of the intermediate layer 16, wherein a suitable punching device would naturally have a smaller-diameter annular cutter on the punching tool and advantageously a greater curvature on the counter-punch surface than that shown in FIG. 7.

The inner peripheral surface of the intermediate layer 16, which is thus substantially frustoconical and delimits the cutout 94 in the intermediate layer 16 towards the outside, has in principle the same effect as the substantially frustoconical outer peripheral surface of the intermediate layer 16, that is to say it leads to the situation where the elastic support of the polishing agent carrier 18 by the radial inner region 20 of the intermediate layer 16 decreases from a region close to the opening 92 in the polishing agent carrier 18 towards the opening 92, in order even at relatively high polishing pressures to ensure that the edge of the opening 92 in the polishing agent carrier 18 is not imprinted on the machined surface F.

Figure 10:
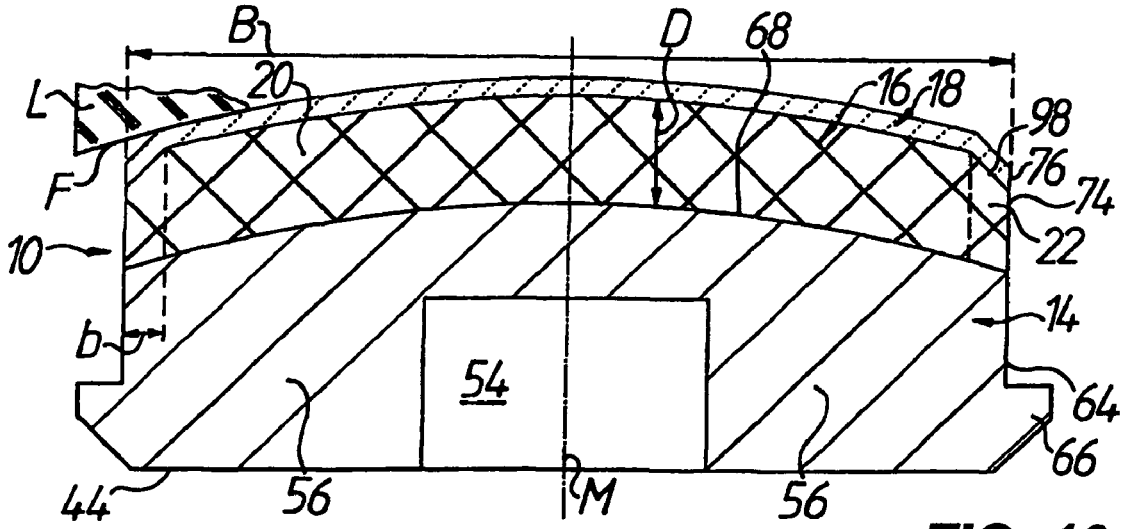
FIG. 10 shows a sectional view, corresponding to the section shown in FIG. 5, of a polishing disc according to a third example of embodiment of the invention, on a scale further enlarged compared to FIG. 5, with a peripheral chamfer on the outer periphery of the intermediate layer, to which the polishing agent carrier is fixed.
Figure 11:
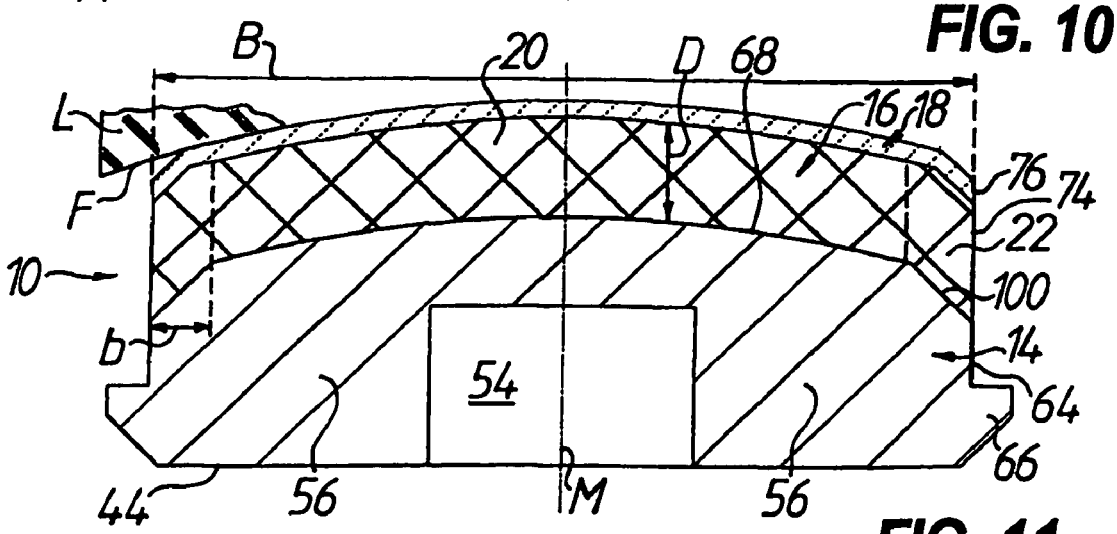
FIG. 11 shows a sectional view, corresponding to the section shown in FIG. 5, of a polishing disc according to a fourth example of embodiment of the invention, on a scale further enlarged compared to FIG. 5, with a peripheral chamfer on the outer periphery of the main body, to which the intermediate layer is fixed.
Figure 12:
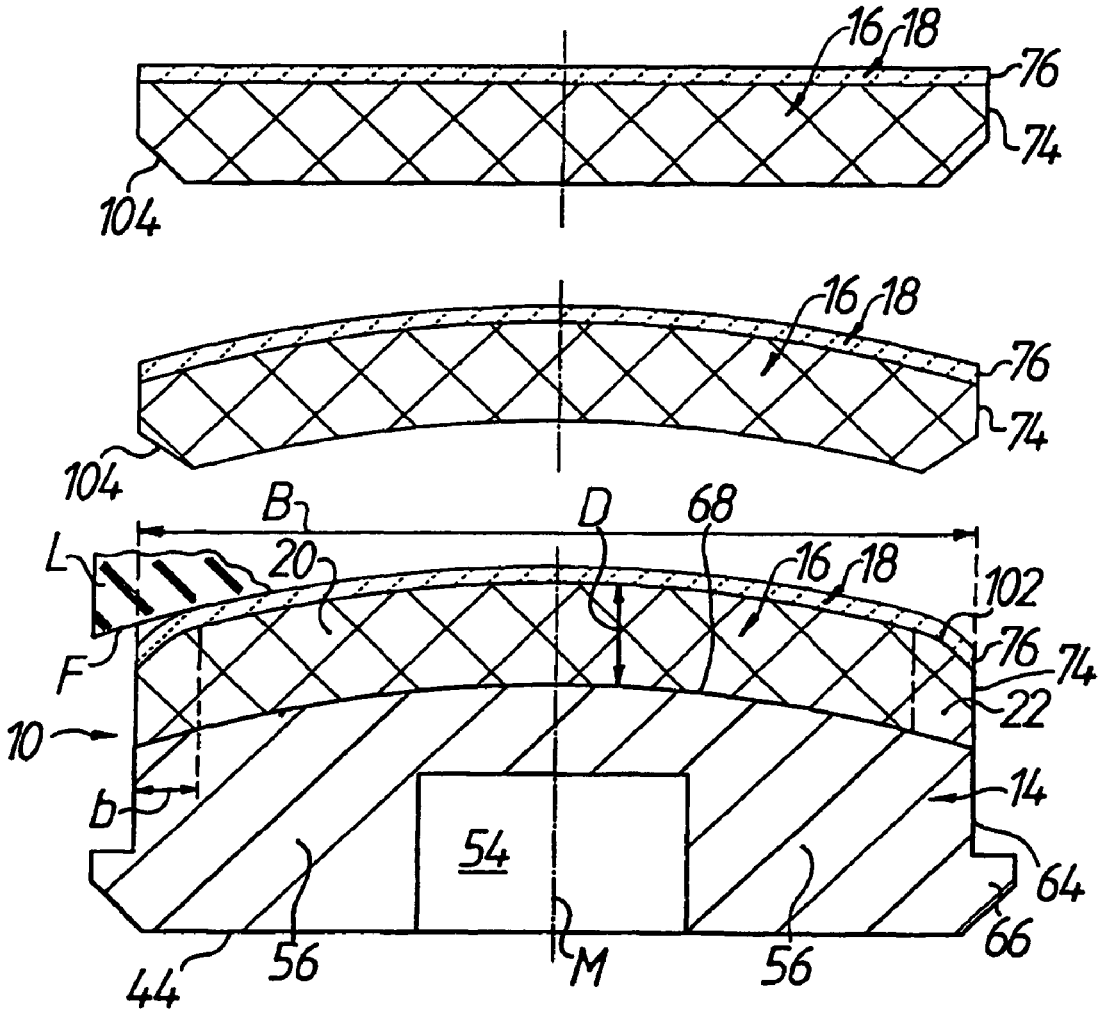
FIG. 12 shows a sectional view, corresponding to the section shown in FIG. 5, of a polishing disc according to a fifth example of embodiment of the invention which is similar to the third example of embodiment according to FIG. 10, on a scale further enlarged compared to FIG. 5, wherein the upper part of FIG. 12 shows how a peripheral edge rounding is produced on the side of the intermediate layer facing towards the polishing agent carrier by means of a peripheral chamfer on the underside of the intermediate layer, which is not yet fixed to the main body, by deforming the intermediate layer and securely adhesively bonding it also in the region of the chamfer to the main body and finally to the finished polishing disc.

Such central openings 92 and cutouts 94, 96 may also be used in the further examples of embodiments shown in FIGS. 10 to 12.

One common feature of the further examples of embodiments shown in FIGS. 10 to 12 is the fact that the outer edge 76 of the polishing agent carrier 18 is kept at a distance from the optically active surface F by means of the radial outer region 22 of the intermediate layer 16 during the fine machining of said optically active surface. This is illustrated on the left-hand side in each case in FIGS. 10 to 12.

To this end, in the third example of embodiment shown in FIG. 10, the intermediate layer 16 is provided with a peripheral chamfer 98 or edge rounding in the radial outer region 22 on the side facing towards the polishing agent carrier 18, wherein the polishing agent carrier 18 is fixed, namely adhesively bonded, to the intermediate layer 16 also in the region of the chamfer 98 or edge rounding, so that the outer edge 76 of the polishing agent carrier 18 becomes spaced away as it were from the optically active surface F during the machining of the latter, in order to prevent the outer edge 76 from being imprinted on the machined surface F.

A corresponding effect is achieved in the further examples of embodiments shown in FIGS. 11 and 12. For example, in the fourth example of embodiment shown in FIG. 11, a peripheral chamfer 100 or edge rounding is formed on the outer peripheral surface 64 of the main body 14 on the side thereof facing towards the intermediate layer 16, on which chamfer or edge rounding the intermediate layer 16 is fixed, namely adhesively bonded, with its radial outer region 22 so that, once again, the outer edge 76 of the polishing agent carrier 18 is kept away from the optically active surface F by the intermediate layer 16, or more specifically the radial outer region 22 thereof, during the machining of said optically active surface.

FIG. 12 furthermore illustrates how a peripheral edge rounding 102—which is in principle similar to the third example of embodiment shown in FIG. 10 but ultimately creates a smoother and softer transition between the radial inner region 20 and the radial outer region 22 of the intermediate layer 16—on the side of the intermediate layer 16 facing towards the polishing agent carrier 18 is formed on the finished polishing disc 10 (FIG. 12, bottom) by a peripheral chamfer 104 on the side of the intermediate layer 16 facing away from the polishing agent carrier 18 (FIG. 12, top), said intermediate layer not yet being fixed to the main body 14. It is obvious to the person skilled in the art that the edge rounding 102 on the intermediate layer 16, which follows the shape of the polishing agent carrier 18 on the finished polishing disc 10, is produced only when the chamfer 104 on the intermediate layer 16 is adhesively bonded flat to the main body 14 with deformation or bending of said intermediate layer.

Finally, it is possible to combine the measures described above. For example, the chamfers (or edge roundings) 98, 100 and/or 104 on the intermediate layer 16 and main body 14 may also be used in the first example of embodiment shown in particular in FIGS. 1, 5 and 6, and may be combined with one another (FIG. 10 with FIG. 11 and/or FIG. 12; FIG. 11 with FIG. 12), depending on the respective machining requirements. Corresponding measures (chamfers on the intermediate layer 16, top and/or bottom, and/or chamfer on the main body) may also be applied in the region of the cutout 94 in the intermediate layer 16 (second example of embodiment shown in FIG. 9), so that the edge of the opening 92 is optionally and additionally becomes spaced away from the machined surface F in order to avoid any imprints. The inner peripheral surface of the intermediate layer 16 which delimits the cutout 94 may then also have a different basic shape, e.g. may be cylindrical.

There is disclosed a polishing disc for a tool for the fine machining of optically active surfaces particularly on spectacle lenses as workpieces, said polishing disc comprising a main body which has a center axis and on which there is fixed an intermediate layer which is softer than the main body and on which a polishing agent carrier rests. The intermediate layer has, with respect to the center axis, a radial inner region of substantially constant axial thickness and an adjoining radial outer region. The latter is formed or is fixed to the main body in a particular way so as to prevent the edge of the polishing disc from being imprinted on the machined surface of the workpiece in the form of very fine, scratch-like microstructures. Also proposed is a simple method which can be used to produce such a polishing disc.

Variations and modifications are possible without departing from the scope and spirit of the present invention as defined by the appended claims.

We claim:

1. A polishing disc for a tool for the fine machining of optically active surfaces particularly on spectacle lenses, the polishing disc comprising a main body which has a center axis and on which there is fixed an intermediate layer which is softer than the main body and on which a polishing agent carrier rests; wherein the intermediate layer has, with respect to the center axis, a radial inner region of substantially constant axial thickness and an adjoining radial outer region having radial outer dimensions which increase from the main body towards the polishing agent carrier, so that elastic support of the polishing agent carrier by the intermediate layer in the radial outer region thereof decreases towards the outer edge of the polishing agent carrier, wherein the polishing agent carrier is provided with at least one reservoir opening for polishing agent in a central region, wherein the at least one opening in the polishing agent carrier is adjoined in the direction of the main body by a reservoir cutout in the intermediate layer, and wherein a diameter of the reservoir cutout in the intermediate layer increases from the opening in the polishing agent carrier towards the main body;

said reservoir cutout having a closed end in proximity to or within said main body.

2. A polishing disc according to claim 1, wherein the radial outer region of the intermediate layer has a substantially frustoconical outer peripheral surface.

3. A polishing disc according to claim 1, wherein the cutout in the intermediate layer extends as far as the main body.

4. A polishing disc according to claim 3, wherein the cutout in the intermediate layer is adjoined by a cutout in the main body.

5. A polishing disc according to claim 1, wherein the polishing disc has a non-deformed state in which a maximum radial width of the radial outer region of the intermediate layer is between 3 and 10% of a maximum total width of the intermediate layer.

6. A method for producing a polishing disc according to claim 1, comprising the following steps:

forming the main body, providing a flat raw material for the intermediate layer, which has a substantially constant thickness, pulling taut the raw material for the intermediate layer over a convexly curved surface of a counter-punch and punching out the intermediate layer by means of a punching tool having an annular cutter, and adhesively bonding the main body and the intermediate layer to form a sandwich-like assembly.

7. A method according to claim 6, wherein the main body is injection-molded from a plastic.

8. A method according to claim 6, wherein the polishing agent carrier is cut to match the larger end face of the non-deformed intermediate layer, and wherein the polishing agent carrier is adhesively bonded with the main body and intermediate layer to form the sandwich-like assembly.

9. A method according to claim 8, wherein the cutting of the polishing agent carrier takes place by means of the punching tool and the counter-punch for punching out the intermediate layer.

10. A method according to claim 9, wherein the punching-out of the intermediate layer and the cutting of the polishing agent carrier take place in a common operating step.

11. A polishing disc for a tool for the fine machining of optically active surfaces particularly on spectacle lenses, the polishing disc comprising a main body which has a center axis and on which there is fixed an intermediate layer which is softer than the main body and on which a polishing agent carrier rests: wherein the intermediate layer has, with respect to the center axis, a radial inner region of substantially constant axial thickness and an adjoining radial outer region having radial outer dimensions which increase from the main body towards the polishing agent carrier, so that elastic support of the polishing agent carrier by the intermediate layer in the radial outer region thereof decreases towards the outer edge of the polishing agent carrier, wherein the polishing agent carrier is provided with at least one opening in a central region, wherein the at least one opening in the polishing agent carrier is adjoined in the direction of the main body by a cutout in the intermediate layer, and wherein a diameter of the cutout in the intermediate layer increases from the opening in the polishing agent carrier towards the main body; and wherein the main body has a substantially spherical end face facing towards the intermediate layer, to which end face the intermediate layer is securely adhesively bonded.

12. A polishing disc for a tool for the fine machining of optically active surfaces particularly on spectacle lenses, comprising a main body which has a center axis and on which there is fixed an intermediate layer which is softer than the main body and on which a polishing agent carrier rests; wherein the intermediate layer has, with respect to the center axis, a substantially uniformly thick region and an adjoining radial outer region, wherein the polishing agent carrier has an outer edge which is spaced from the optically active surface at the radial outer region of the intermediate layer during the fine machining of said optically active surface when set to be normal to the center axis, wherein the intermediate layer has one of a peripheral chamfer and an edge rounding in the radial outer region on the side facing towards the polishing agent carrier, wherein the polishing agent carrier is also fixed to the intermediate layer proximate to one of the peripheral chamfer and edge rounding; and wherein the main body has a substantially spherical end face facing towards the intermediate layer, to which end face the intermediate layer is securely adhesively bonded.

13. A polishing disc for a tool for the fine machining of optically active surfaces particularly on spectacle lenses, comprising a main body which has a center axis and on which there is fixed an intermediate layer which is softer than the main body and on which a polishing agent carrier rests; wherein the intermediate layer has, with respect to the center axis, a substantially uniformly thick region and an adjoining radial outer region, wherein the polishing agent carrier has an outer edge which is spaced from the optically active surface at the radial outer region of the intermediate layer during the fine machining of said optically active surface when set to be normal to the center axis, wherein the intermediate layer has one of a peripheral chamfer and an edge rounding in the radial outer region on the side facing towards the polishing agent carrier, wherein the polishing agent carrier is also fixed to the intermediate layer proximate to one of the peripheral chamfer and edge rounding, wherein the polishing agent carrier is provided with at least one opening in a central region; and wherein the at least one opening in the polishing agent carrier is adjoined in the direction of the main body by a cutout in the intermediate layer.

14. A polishing disc according to claim 13, wherein the cutout in the intermediate layer extends as far as the main body.

15. A polishing disc according to claim 14, wherein the cutout in the intermediate layer is adjoined by a cutout in the main body.

16. A polishing disc according to claim 13, wherein a diameter of the cutout in the intermediate layer increases from the opening in the polishing agent carrier towards the main body.

17. In combination, a tool for the fine machining of optically active surfaces particularly on spectacle lenses, and a polishing disc according to claim 1, the tool comprising:

a main body which can be attached to a tool spindle of a machining machine, an articulated part which has a holding section guided such that it can be tilted and moved longitudinally with respect to the main body, which holding section is adjoined in the direction of the main body by a bellows section, by which the articulated part is fixed to the main body such that it can rotate therewith, a pressure medium chamber which is delimited by the main body and the articulated part and which can selectively be acted upon by a pressure medium, and wherein the polishing disc is held on the holding section of the articulated part in an exchangeable manner.

18. A combination of tool and polishing disc according to claim 17, wherein the polishing disc is held on the holding section of the articulated part by a snap-in connection.

19. A combination of tool and polishing disc according to claim 17, wherein the polishing disc is held on the holding section of the articulated part and is rotatably driven by the articulated part.

20. A polishing disc for a tool for the fine machining of optically active surfaces particularly on spectacle lenses, the polishing disc comprising a main body which has a center axis and on which there is fixed an intermediate layer which is softer than the main body and on which a polishing agent carrier rests; wherein the intermediate layer has, with respect to the center axis, a radial inner region of substantially constant axial thickness and an adjoining radial outer region having radial outer dimensions which increase from the main body towards the polishing agent carrier, so that elastic support of the polishing agent carrier by the intermediate layer in the radial outer region thereof decreases towards the outer edge of the polishing agent carrier, wherein the polishing disc is provided with a polishing agent reservoir in a central region, wherein the reservoir has a closed end in proximity to or within said main body and with at least one opening through said polishing agent carrier.

21. A polishing disc according claim 20, wherein a diameter of the reservoir increases from the opening in the polishing agent carrier towards the main body.

22. A polishing disc according the claim 20, wherein the reservoir is formed by the polishing agent carrier being provided with at least one opening in a central region, wherein the at least one opening in the polishing agent carrier is adjoined in the direction of the main body by a cutout in the intermediate layer.

* * * * *